US005895557A

United States Patent [19]

Kronzer

[11] Patent Number: 5,895,557

[45] Date of Patent: Apr. 20, 1999

[54] LATEX-SATURATED PAPER

[75] Inventor: Francis Joseph Kronzer, Marietta, Ga.

[73] Assignee: Kimberly-Clark Worldwide, Inc., Neenah, Wis.

[21] Appl. No.: 08/736,349

[22] Filed: Oct. 3, 1996

[51] Int. Cl.[6] ..... D21H 11/00; D21H 17/57

[52] U.S. Cl. ..... 162/168.1; 162/169.1; 162/183; 162/140; 162/168.2; 428/195; 428/211

[58] Field of Search ..... 162/168.1, 169, 162/183, 184, 140, 135, 168.2, 168.3; 427/391; 428/195, 211, 423.1

[56] References Cited

U.S. PATENT DOCUMENTS

| | | | |
|---|---|---|---|
| 3,939,648 | 2/1976 | Huebner et al. | 162/169 X |
| 4,121,966 | 10/1978 | Amano et al. | 162/169 X |
| 4,371,582 | 2/1983 | Sugiyama et al. | 428/341 |
| 4,445,972 | 5/1984 | Bartelloni | 162/164.1 |
| 4,510,019 | 4/1985 | Bartelloni | 162/141 |
| 4,830,911 | 5/1989 | Kojima et al. | 428/342 |
| 5,200,036 | 4/1993 | Noda | 162/164.3 |
| 5,254,403 | 10/1993 | Malhotra | 428/342 |
| 5,302,437 | 4/1994 | Idei et al. | 428/195 |
| 5,320,897 | 6/1994 | Kondo et al. | 428/195 |
| 5,364,702 | 11/1994 | Idei et al. | 428/423.1 |
| 5,397,619 | 3/1995 | Kuroyama et al. | 428/141 |
| 5,405,678 | 4/1995 | Bilodeau | 428/211 |
| 5,425,998 | 6/1995 | Minakawa et al. | 428/494 |
| 5,478,631 | 12/1995 | Kawano et al. | 428/212 |
| 5,484,839 | 1/1996 | Wang et al. | 524/533 |
| 5,565,062 | 10/1996 | Nass et al. | 162/168.1 |

*Primary Examiner*—Stanley S. Silverman
*Assistant Examiner*—José S. Fortuna
*Attorney, Agent, or Firm*—William E. Maycock

[57] ABSTRACT

A saturated paper suitable for use in a clean room environment, which paper includes a fibrous web in which at least about 50 percent of the fibers comprising the web, on a dry weight basis, are cellulosic fibers. The paper also includes a saturant which is present in the saturated paper at a level of from about 10 to about 100 percent, based on the dry weight of the fibrous web. The saturant, in turn, includes from about 98 to about 70 percent, on a dry weight basis, of a latex reinforcing polymer having a glass transition temperature of from about −40° C. to about 25° C.; and from about 2 to about 30 percent, on a dry weight basis, of a cationic polymer. The saturant is adapted to render the saturated paper durable, low linting, and ink jet printable.

20 Claims, No Drawings

LATEX-SATURATED PAPER

BACKGROUND OF THE INVENTION

The present invention relates to a latex-saturated or polymer-reinforced paper. More particularly, the present invention relates to a latex-saturated or polymer-reinforced paper which may be used in a clean room environment.

Clean room documentation paper may be used to record the results of various steps in a clean room manufacturing process. It also may be used as copier paper and as computer forms. Clean room paper also may be used in roll form to print equipment operation manuals and for such ancillary uses as notebooks and memo pads. The type of paper used primarily for recording is 8.5 inch by 11 inch cut sheets. These standard sheets normally are printed by the user (although printing may be contracted). Most forms use either different colors of ink or papers of different colors to identify different forms. The primary attribute of any paper used in a clean room is that the paper must generate a low number of particulates into the environment. Other product attributes include copyability, writability, printability, durability, and price.

Paper used in a clean room is, of course, a potential source of contamination by the emission of particles. Such emissions are believe to originate from either particles deposited on the surfaces of the paper during its manufacture, handling, and storage, or from the mechanical disintegration of the paper itself. Thus, particles may be generated by disintegration of the paper structure under high stresses that accompany folding, creasing, abrading, or shredding. Such disintegration represents an unavoidable source of particle emissions which is a characteristic of all papers, although some paper structures are less vulnerable to disintegration and, as a consequence, less likely to shed particles under normal usage.

Standard papers used for documentation, such as bond papers, typically generate 5,000 to 40,000 particles, 0.5 micrometers or larger, per linear inch when crumpled or torn. Polymer-reinforced papers (often referred to herein as saturated papers or latex-saturated papers) typically have low particle generation from tearing actions. The reinforcement of paper by polymer impregnation, of course, is a long-established practice. The polymer employed typically is a synthetic material, and the paper can consist solely of cellulosic fibers or of a mixture of cellulosic and noncellulosic fibers. Polymer reinforcement is employed to improve one or more of such properties as dimensional stability, resistance to chemical and environmental degradation, resistance to tearing, embossability, resiliency, conformability, moisture and vapor transmission, and abrasion resistance, among others. Papers containing only synthetic thermoplastic fibers, such as Tyvek®, are very difficult to tear and generate very low levels of particulates. Such papers, however, typically cannot be copied and are relatively expensive.

Accordingly, there is a need for a paper which is suitable for use in a clean room, but which is durable, less expensive than synthetic papers, and is capable of being copied and/or printed on.

SUMMARY OF TH INVENTION

The present invention addresses some of the difficulties and problems discussed above by providing a saturated paper which is suitable for use in a clean room environment. The saturated paper includes a fibrous web in which at least about 50 percent of the fibers comprising the web, on a dry weight basis, are cellulosic fibers. The paper also includes a saturant which is present in the saturated paper at a level of from about 10 to about 100 percent, based on the dry weight of the fibrous web. The saturant, in turn, includes from about 98 to about 70 percent, on a dry weight basis, of a latex reinforcing polymer having a glass transition temperature of from about −40° C. to about 25° C.; and from about 2 to about 30 percent, on a dry weight basis, of a cationic polymer. By way of example, the latex reinforcing polymer may have glass transition temperature of from about −15° C. to about 15° C. Also by way of example, substantially all of the fibers of which the fibrous web is composed may be cellulosic fibers.

The saturant is adapted to render the saturated paper durable, low linting, and ink jet printable. For example, the saturant may be present in the saturated paper at a level of from about 20 to about 70 percent. As another example, the saturant may be present in the saturated paper at a level of from about 30 to about 60 percent. As a further example, the cationic polymer may be present in the saturant at a level of from about 4 to about 20 percent. As still another example, the cationic polymer may be present in the saturant at a level of from about 7 to about 15 percent. If desired, the saturant also may contain a filler at a level up to about 20 percent, on a dry weight basis. An example of a particularly useful filler is titanium dioxide.

DETAILED DESCRIPTION OF THE INVENTION

As used herein, the term "fibrous web" is used herein to mean a web or sheet-like structure which is, in whole or in part, formed from fibers. In the examples, the fibrous web is referred to for convenience as the base paper.

In general, the fibers present in the fibrous web (or base paper) consist of at least about 50 percent by weight of cellulosic fibers. Thus, noncellulosic fibers such as mineral and synthetic fibers may be included, if desired. Examples of noncellulosic fibers include, by way of illustration only, glass wool and fibers prepared from thermosetting and thermoplastic polymers, as is well known to those having ordinary skill in the art.

In many embodiments, substantially all of the fibers present in the paper will be cellulosic fibers. Sources of cellulosic fibers include, by way of illustration only, woods, such as softwoods and hardwoods; straws and grasses, such as rice, esparto, wheat, rye, and sabai; bamboos; jute; flax; kenaf; cannabis; linen; ramie; abaca; sisal; and cotton and cotton linters. Softwoods and hardwoods are the more commonly used sources of cellulosic fibers. In addition, the cellulosic fibers may be obtained by any of the commonly used pulping processes, such as mechanical, chemimechanical, semichemical, and chemical processes. For example, softwood and hardwood Kraft pulps are desirable for toughness and tear strength, but other pulps, such as recycled fibers, sulfite pulp, and the like may be used, depending upon the application.

As already stated, the paper also includes a saturant which is present in the saturated paper at a level of from about 10 to about 100 percent, based on the dry weight of the fibrous web. For example, the saturant may be present in the saturated paper at a level of from about 20 to about 70 percent. As another example, the saturant may be present in the saturated paper at a level of from about 30 to about 60 percent.

The saturant includes from about 98 to about 70 percent, on a dry weight basis, of a latex reinforcing polymer having a glass transition temperature of from about −40° C. to about 25° C.; and from about 2 to about 30 percent, on a dry weight basis, of a cationic polymer. By way of example, the saturant may include from about 4 to about 80 percent of a latex reinforcing binder. Further by way of example, the latex reinforcing polymer may have glass transition temperature of from about −15° C. to about 15° C. Also by way of example, substantially all of the fibers of which the fibrous web is composed may be cellulosic fibers. While the latex reinforcing polymer may be either nonionic or cationic, nonionic latex reinforcing polymers are desired.

For example, the latex reinforcing polymer may be an ethylene-vinyl acetate copolymer or a nonionic polyacrylate. Examples of cationic polymers include, by way of illustration only, polyamides, amide-epichlorohydrin resins, polyethyleneimines, polyacrylamides, and urea-formaldehyde resins.

The saturated paper of the present invention may be made in accordance with known procedures. Briefly, and by way of illustration only, the paper may be made by preparing an aqueous suspension of fibers with at least about 50 percent, by dry weight, of the fibers being cellulosic fibers; distributing the suspension on a forming wire; removing water from the distributed suspension to form a paper; and treating the paper with the saturant. In general, the aqueous suspension is prepared by methods well known to those having ordinary skill in the art. Similarly, methods of distributing the suspension on a forming wire and removing water from the distributed suspension to form a paper also are well known to those having ordinary skill in the art.

The expressions "by dry weight" and "based on the dry weight of the cellulosic fibers" refer to weights of fibers, e.g., cellulosic fibers, or other materials which are essentially free of water in accordance with standard practice in the papermaking art. When used, such expressions mean that weights were calculated as though no water were present.

If desired, the paper formed by removing water from the distributed aqueous suspension may be dried prior to the treatment of the paper with the saturant. Drying of the paper may be accomplished by any known means. Examples of known drying means include, by way of illustration only, convection ovens, radiant heat, infrared radiation, forced air ovens, and heated rolls or cans. Drying also includes air drying without the addition of heat energy, other than that present in the ambient environment.

In addition to noncellulosic fibers, the aqueous suspension may contain other materials as is well known in the papermaking art. For example, the suspension may contain acids and bases to control pH, such as hydrochloric acid, sulfuric acid, acetic acid, oxalic acid, phosphoric acid, phosphorous acid, sodium hydroxide, potassium hydroxide, ammonium hydroxide or ammonia, sodium carbonate, sodium bicarbonate, sodium dihydrogen phosphate, disodium hydrogen phosphate, and trisodium phosphate; alum; sizing agents, such as rosin and wax; dry strength adhesives, such as natural and chemically modified starches and gums; cellulose derivatives such as carboxymethyl cellulose, methyl cellulose, and hemicellulose; synthetic polymers, such as phenolics, latices, polyamines, and polyacrylamides; wet strength resins, such as urea-formaldehyde resins, melamine-formaldehyde resins, and polyamides; fillers, such as clay, talc, and titanium dioxide; coloring materials, such as dyes and pigments; retention aids; fiber deflocculants; soaps and surfactants; defoamers; drainage aids; optical brighteners; pitch control chemicals; slimicides; and specialty chemicals, such as corrosion inhibitors, flame-proofing agents, and anti-tamish agents.

Generally speaking, a very porous, open, absorbent paper is desired prior to saturation. The absorbency and porosity of the papers may be measured by known methods, such as Tappi Test Method No. T460 to measure Gurley porosity, while wetting or wicking tests may be used to measure absorbency. Such tests and requirements for making paper for saturating are well known in the art.

The basis weight of the latex-saturated paper may be whatever is needed for the end use. For example, the basis weight of the latex-saturated paper may be in a range of from about 40 to about 240 gsm. Generally, a finished basis weight of about 80 grams per square meter (about 60 grams of pulp and 20 grams of saturant) is useful for most applications such as booklets, pamphlets and the like. Heavier papers, up to three times as heavy, may be desired for heavier duty applications such as booklet covers and various tags. However, lighter or even heavier papers may be employed and come within the scope of the present invention.

In general, any method of saturating the paper may be employed. The method described in the examples is typical. In fact, some of the cationic polymer may be added to the pulp slurry as well as to the saturant, provided that the total amounts of the cationic and latex reinforcing polymers are in the ranges described. Upon saturating the wet-laid paper, any cationic polymer present in the pulp slurry or furnish is, for all practical purposes, present in the paper as though it had been added to the paper in the saturant.

The present invention is further described by the examples which follow. Such examples, however, are not to be construed as limiting in any way either the spirit or the scope of the present invention.

EXAMPLES

A number of different base papers, binders, and cationic polymers were employed in the examples. For convenience, all of these materials are described first.

Base Paper I (BI)

This base paper was composed of 30 percent by weight of bleached hardwood Kraft pulp and 70 percent by weight of bleached softwood Kraft pulp, both on a dry weight basis. The basis weight of the paper was 60 grams per square meter (gsm). The Gurley porosity of the paper was 18 sec/100 cc.

Base Paper II (BII)

Base Paper II was composed of 100 percent softwood Kraft pulp and had a basis weight of 60 gsm. The Gurley porosity of the paper was 6 sec/100 cc.

Latex Binder I (LI)

Latex Binder I was a nonionic ethylene-vinyl acetate copolymer latex having a glass transition temperature of 0° C. (Airflex® 140, Air Products and Chemicals, Inc., Allentown, Pa.).

Latex Binder II (LII)

This binder was a nonionic, self crosslinking ethylene-vinyl acetate copolymer latex having a glass transition temperature of 3° C. (Airflex® 125, Air Products and Chemicals, Inc., Allentown, Pa.).

Latex Binder III (LIII)

Latex Binder III was a nonionic acrylic polymer latex having a glass transition temperature of −4° C. (Rhoplex® B-15, Rohm and Haas Company, Philadelphia, Pa.).

Cationic Polymer CI

Cationic Polymer CI was an amide-epichlorohydrin condensate (Reten® 204 LS, Hercules, Inc. Wilmington, Del.).

Cationic Polymer CII

This cationic polymer was a cationic polyacrylamide (Parez® 631 NC, American Cyanamid, Wayne, N.J.).

Cationic Polymer CIII

Cationic Polymer CIII was an amide-epichlorohydrin condensate (Kymene® 557 LX, Hercules, Inc. Wilmington Del.).

Cationic Polymer IV (CIV)

Cationic Polymer IV was a cationic retention aid (Polymin® PR 971, BASF, Parsippany, N.J.).

Cationic Polymer V (CV)

This cationic polymer was a polymerized quaternary ammonium salt (Calgon® 261LV, Calgon Corporation, Pittsburgh, Pa.).

Additive I (AI)

Additive I was a polyethylene oxide (Polyox N60R®, Union Carbide Corporation, Danbury, Conn.).

Additive II (AII)

Additive II was methyl cellulose (Methocell® A-15, Dow Chemical Company, Midland, Mich.).

Additive III (AIII)

Additive III was rutile titanium dioxide from DuPont, Wilmington, Del., and dispersed with Calgon CRS-A (Calgon Corporation, Pittsburgh, Pa.).

To prepare an example of a saturated paper, a base paper sample was treated by soaking in a saturant, squeezing out excess saturant with an Atlas Laboratory Wringer having a nip setting of about 20 lb. (about 9 kg), and drying on steam-heated cans. The percent add-on was 30 parts per 100 parts of fiber for Base Paper I and 50 parts for Base Paper II. Each saturated sample was steel roll calender at 10 psi nip pressure, then printed with a red, yellow, gray, and black test pattern on a Canon BJ 600 color printer. After several minutes, each sample was tested for water fastness by placing about 20 drops of water on the surface, letting them stand for one minute, then wiping them off. The samples prepared in accordance with this procedure are summarized in Table II (based on 100 parts of latex), and the test results are summarized in Table III.

TABLE II

Example Descriptions

| Example No. | Base Paper | Parts[a] Latex | $TiO_2$ | Cationic Polymer Type | Cationic Polymer Parts[a] | Saturant Add-On[a] | Parts[a] Al |
|---|---|---|---|---|---|---|---|
| EI | BI | LI | 0 | CI | 13.5 | 30 | 0.5 |
| EII | BI | LI | 10 | CI | 13.5 | 30 | 0.5 |
| EIII | BI | LI | 20 | CI | 13.5 | 30 | 0.5 |
| EIV | BII | LI | 20 | CI | 13.5 | 50 | 0.5 |
| EV | BI | LI | 20 | CI | 13.5 | 30 | —[b] |
| EVI | BI | LI | 20 | CI | 13.5 | 30 | 1.0 |
| EVII | BI | LI | 20 | CI | 27 | 30 | 0.5 |
| EVIII | BI | LI | 20 | — | — | 30 | 0.5 |
| EIX | BI | LII | 20 | CI | 13.5 | 30 | 0.5 |
| EX | BI | LIII | 20 | CI | 13.5 | 30 | 0.5 |
| EXI | BI | LII | 0 | CI | 6.7 | 30 | — |
| EXII | BI | LII | 0 | CII | 13.5 | 30 | — |
| EXIII | BI | LII | 0 | CIII | 13.5 | 30 | — |
| EXIV | BI | LII | 0 | CIV | 13.5 | 30 | — |
| EXV | BI | LII | 0 | CV | 13.5 | 30 | — |

[a]Parts per 100 parts of latex reinforcing polymer (latex).
[b]Not present.

TABLE III

Test Results

| Example No. | Print Test | Water Test | Other |
|---|---|---|---|
| EI | Good | Good | |
| EII | Good | Good | |
| EIII | Good | Good | |
| EIV | Good | Good | Particulate test gave 35 particles over 5 micrometers and 558 particles over 0.3 micrometers[b] |
| EV | Good | Good | |
| EVI | Good | Good | |
| EVII | Good | Good | |
| EVIII | Good | Good | |
| EIX | Good | Good | Saturant thickened |
| EX | Poor[a] | Good | |
| EXI | Good | Good | |
| EXII | — | — | Saturant gelled |
| EXIII | Good | Fair | |
| EXIV | Good | Good | |
| EXV | Good | Fair | |

[a]Some ink discoloration.
[b]Per cubic foot of air (these values are approximately equivalent to 1.2 and 20 particles per liter, respectively, or 1,236 and 19,710 particles per cubic meter, respectively); ordinary bond paper generated millions of particles when tested by the same procedure.

Particles generated were counted with a Model A2408-1-115-1 Laser Particle Counter (Met One, Grants Pass, Oreg.) in a clean room (Class 100) air flow hood, generally in accordance with the manufacturer's instructions.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A saturated paper comprising:

a fibrous web in which at least about 50 percent of the fibers comprising the web, on a dry weight basis, are cellulosic fibers; and a saturant which is present in the saturated paper at a level of from about 10 to about 100 percent, based on the dry weight of the fibrous web; in which the saturant comprises:

from about 98 to about 70 percent, on a dry weight basis, of a nonionic or cationic latex reinforcing polymer having a glass transition temperature of from about −40° C. to about 25° C.; and from about 2 to about 30 percent, on a dry weight basis, of a cationic polymer; wherein the saturant is adapted to render the saturated paper durable, low linting, and ink jet printable.

2. The saturated paper of claim 1, in which the saturant is present in the saturated paper at a level of from about 20 to about 70 percent.

3. The saturated paper of claim 1, in which the saturant is present in the saturated paper at a level of from about 30 to about 60 percent.

4. The saturated paper of claim 1, in which the latex reinforcing polymer has a glass transition temperature of from about −15° C. to about 15° C.

5. The saturated paper of claim 1, in which the cationic polymer is present in the saturant at a level of from about 4 to about 20 percent.

6. The saturated paper of claim 1, in which the cationic polymer is present in the saturant at a level of from about 7 to about 15 percent.

7. The saturated paper of claim 1, in which the saturant also contains a filler at a level up to about 20 percent, on a dry weight basis.

8. The saturated paper of claim 7, in which the filler is titanium dioxide.

9. The saturated paper of claim 1, in which substantially all of the fibers comprising the fibrous web are cellulosic fibers.

10. A saturated paper comprising:

a fibrous web in which at least about 50 percent of the fibers comprising the web, on a dry weight basis, are cellulosic fibers; and a saturant which is present in the saturated paper at a level of from about 20 to about 70 percent, based on the dry weight of the fibrous web; in which the saturant comprises:

from about 96 to about 80 percent, on a dry weight basis, of a nonionic or cationic latex reinforcing polymer having a glass transition temperature of from about −15° C. to about 15° C.; and from about 4 to about 20 percent, on a dry weight basis, of a cationic polymer; wherein the saturant is adapted to render the saturated paper durable, low linting, and ink jet printable.

11. The saturated paper of claim 10, in which the saturant is present at a level of from about 30 to about 70 percent.

12. The saturated paper of claim 10, in which the cationic polymer is present in the saturant at a level of from about 7 to about 15 percent.

13. The saturated paper of claim 10, in which the saturant also contains a filler at a level up to about 20 percent, on a dry weight basis.

14. The saturated paper of claim 13, in which the filler is titanium dioxide.

15. The saturated paper of claim 10, in which substantially all of the fibers comprising the fibrous web are cellulosic fibers.

16. A saturated paper comprising:

a fibrous web in which substantially all of the fibers comprising the web are cellulosic fibers; and a saturant which is present in the saturated paper at a level of from about 20 to about 70 percent, based on the dry weight of the fibrous web; in which the saturant comprises:

from about 96 to about 80 percent, on a dry weight basis, of a nonionic or cationic latex reinforcing polymer having a glass trainsition temperature of from about −15° C. to about 15° C.; and from about 4 to about 20 percent, on a dry weight basis, of a cationic polymer; wherein the saturant is adapted to render the saturated paper durable, low linting, and ink jet printable.

17. The saturated paper of claim 16, in which the saturant is present at a level of from about 30 to about 70 percent.

18. The saturated paper of claim 16, in which the cationic polymer is present in the saturant at a level of from about 7 to about 15 percent.

19. The saturated paper of claim 16, in which the saturant also contains a filler at a level up to about 20 percent, on a dry weight basis.

20. The saturated paper of claim 19, in which the filler is titanium dioxide.

* * * * *

UNITED STATES PATENT AND TRADEMARK OFFICE

CERTIFICATE OF CORRECTION

PATENT NO. : 5,895,557

DATED : April 20, 1999

INVENTOR(S) : Francis Joseph Kronzer

It is certified that error appears in the above-identified patent and that said Letters Patent is hereby corrected as shown below:

On the title page,, item [56]:

Page 1, line 25, "3,939,648" should read -- 3,937,648 --;
Column 1, line 62, "SUMMARY OF TH INVENTION" should read --SUMMARY OF THE INVENTION--;
Column 5, line 40, Table II Subheading "Parts[a] Latex $TiO_2$" should read -- Parts[a] Latex $TiO_2$ --

Signed and Sealed this

Seventh Day of September, 1999

*Attest:*

*Attesting Officer*

Q. TODD DICKINSON

*Acting Commissioner of Patents and Trademarks*